United States Patent [19]

English et al.

[11] 4,208,853

[45] Jun. 24, 1980

[54] CUT-OFF MECHANISM FOR WRAPPING MACHINES

[76] Inventors: William J. English, 32 Pierce St., West Boylston, Mass. 01583; Donald C. Dechant, 22437 Fairlawn Cir., Cleveland, Ohio 44126

[21] Appl. No.: 968,076

[22] Filed: Dec. 11, 1978

[51] Int. Cl.[2] ..... B65B 41/12; B65B 61/06; B65B 67/08

[52] U.S. Cl. ..... 53/389; 53/390

[58] Field of Search ..... 53/389, 390, 218; 83/372

[56] References Cited

U.S. PATENT DOCUMENTS

| | | | |
|---|---|---|---|
| 2,029,726 | 2/1936 | Laabs | 83/372 X |
| 2,964,895 | 12/1960 | Powers | 53/389 |
| 3,442,064 | 5/1969 | Conti | 53/390 |

*Primary Examiner*—Travis S. McGehee
*Attorney, Agent, or Firm*—Charles R. Fay

[57] ABSTRACT

A cut-off mechanism operated by an electric switch and comprising a fixed blade and a movable shear operated by a rotary solenoid.

4 Claims, 3 Drawing Figures

CUT-OFF MECHANISM FOR WRAPPING MACHINES

BACKGROUND OF THE INVENTION

In wrapping machines of the class herein it has been necessary in the past for the operator to directly manually actuate a relatively resistant shear in order to cut off the wrapping material at each operation, and it is the object of the present invention to provide a very easily and indirectly actuatable device for the purpose described which relieves the operator of an onorous manipulation and saves time in the wrapping process.

SUMMARY OF THE INVENTION

In a wrapping machine of the class described there is an operator's station which includes a table generally having heat sealing apparatus, and receiving a web or webs of heat sealable material for the wrapping operation, guided to the table and easily hand drawn for the wrapping operation. When the wrapping has been substantially complete, the operator manipulates the package itself in a very slight manner to exert tension on the wrapping material web being fed to the wrapping station, and this action actuates a lever in turn actuating e.g. a miroswitch in turn energizing a rotary solenoid operating a rotary shearing cutter which comes down on a partial revolution operating to shear the wrapping material in conjunction with a fixed blade, leaving an extending end of the wrapping material web for easy gripping by the operator for subsequent wrapping operations.

PREFERRED EMBODIMENT OF THE INVENTION

Figure 1:
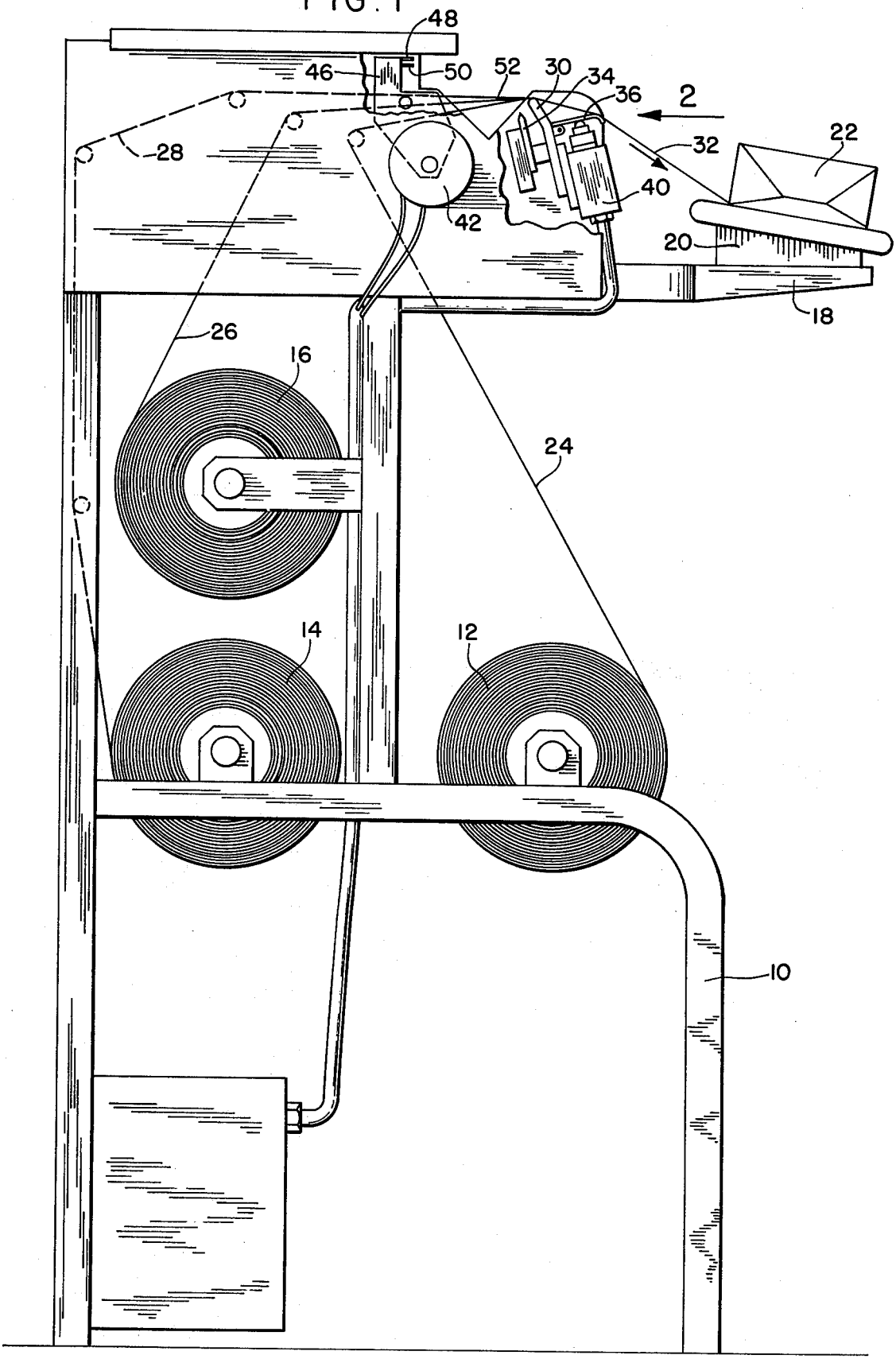
FIG. 1 is a view in elevation illustrating the invention.

A stand 10 of any kind is provided and on this stand there are provided rolls of wrapping materials 12, 14, 16 mounted in the usual manner and capable of presenting three layers of wrapping material to the wrapping station 18. One, two or three layers can be used as needed. The wrapping station may be provided with heat sealing means not shown but old and well known in the art and located at 20, a package being shown at 22.

The webs 24, 26, 28 are fed in the usual manner over directional rollers etc. to a common location passing over a smooth bar or roller 30 and then being directed as at 32 to the package 22.

Figure 3:
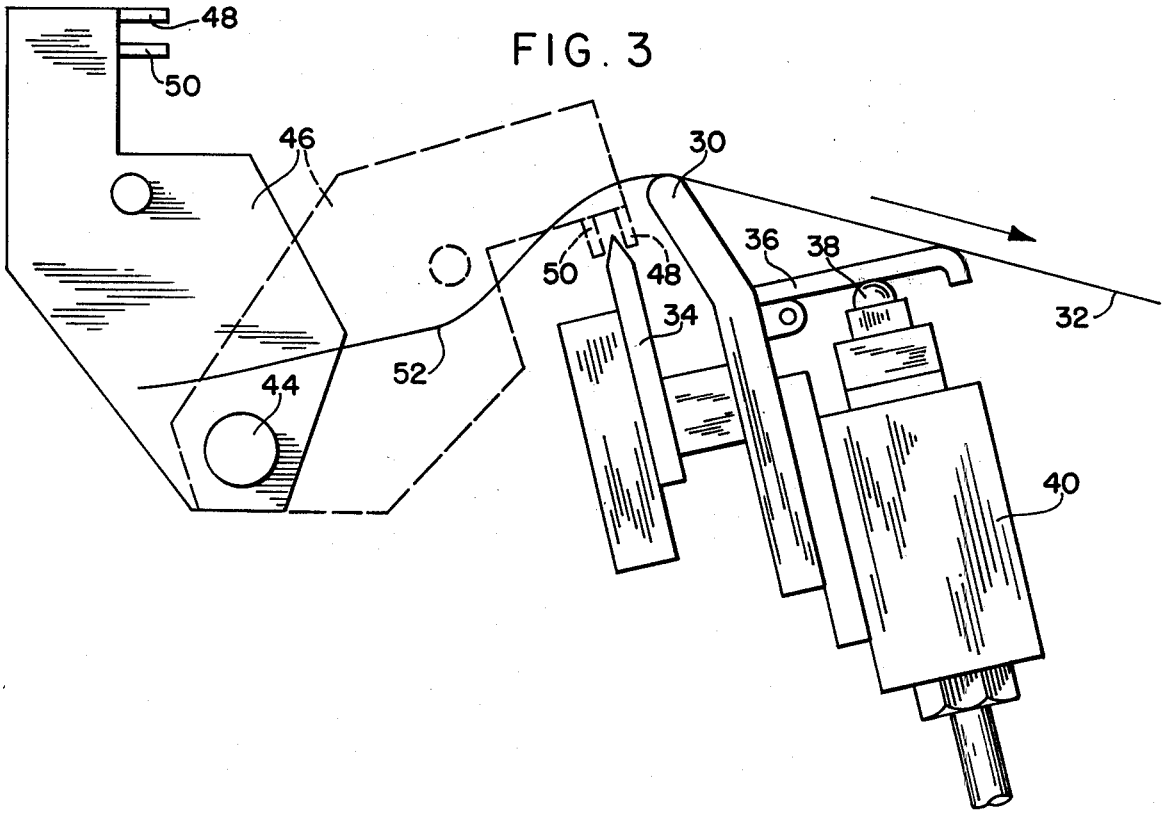
FIG. 3 is an enlarged side elevation of the operative parts of the invention.

Associated with the guide roller or bar 30 there is provided a fixed blade 34 and a pivoted lever 36 which is adapted to actuate a button or the like 38 which in turn will actuate a switch, e.g. microswitch 40 when extra tension is applied in the direction of the arrow in FIG. 3 with reference to the wrapping material 32. It will be seen that extra tension in the direction of the arrow will cause the lever to turn in a clockwise direction actuating the switch.

Figure 2:
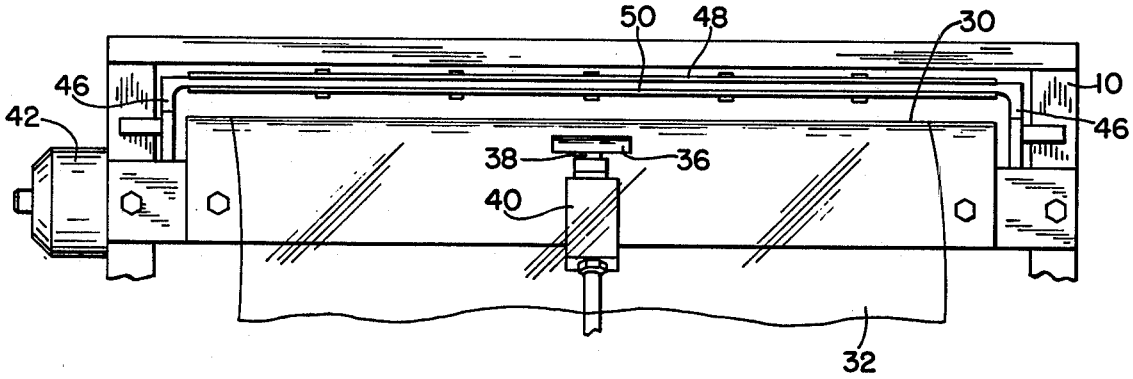
FIG. 2 is a view in front elevation looking in the direction of arrow 2 in FIG. 1.

In FIGS. 1 and 2 the reference character 42 indicates a commerical rotary solenoid. These solenoids are old and well known, the solenoid 42 being under control of switch 40 and mounting through a shaft 44 (FIG. 3) an oscillatable arm 46 having mounted thereon the cutting blade 48 and a pressure member 50. In FIG. 3 these members are shown in solid and dotted line position. The solid line position agrees with the position in FIG. 1, i.e., the blade 48 and arm 46 are in inoperative position; but when tension is applied for instance by pulling package 22 in FIG. 1 slightly to the right, tension is applied to the wrapping material web in the area 32 in the direction of the arrow, actuating lever 36, switch 40, and thereby rotary solenoid 42, which brings the cutting blade 48 down to the cutting position shown in dotted lines in FIG. 3.

The action is of course a unitary action and as soon as the web is cut, the electric energy is released, and the arm 36 returns to normal position.

This action leaves a protruding portion of the wrapping material web as at 52 for the operator to pick up in making the next wrapping action.

I claim:

1. In a wrapping machine, a source of wrapping material, means guiding the wrapping material to an operative wrapping station, a cut-off member, a rotary arm mounting the cut-off member, a rotary solenoid for operating the rotary arm, a switch under control of the tension of the web as it is led to the wrapping station, said switch actuating the solenoid for a single motion in a direction to sever the web in a predetermined location leaving an extending end thereof for the convenience of the wrapping operator.

2. The apparatus of claim 1 including a plurality of sources of supply of the wrapping material.

3. The apparatus of claim 1 wherein said switch is a microswitch.

4. The apparatus of claim 1 wherein said rotary arm includes a severing blade, and a hold-down blade for assisting in the severing operation.

* * * * *